US008100075B2

(12) United States Patent
Wang

(10) Patent No.: US 8,100,075 B2
(45) Date of Patent: Jan. 24, 2012

(54) RUDDER CONTROL ASSEMBLY OF A BOAT

(76) Inventor: Nien Fu Wang, Taoyuan Hsien (TW)

( * ) Notice: Subject to any disclaimer, the term of this patent is extended or adjusted under 35 U.S.C. 154(b) by 1815 days.

(21) Appl. No.: 11/272,945

(22) Filed: Nov. 15, 2005

(65) Prior Publication Data

US 2010/0269744 A1 Oct. 28, 2010

(51) Int. Cl.
*B63H 25/10* (2006.01)

(52) U.S. Cl. ..... 114/153; 114/162

(58) Field of Classification Search ..... 114/144 R, 114/150, 153; 440/63
See application file for complete search history.

(56) References Cited

U.S. PATENT DOCUMENTS 2,939,417 A * 6/1960 Hammock, Sr. ..... 114/150
5,127,862 A * 7/1992 Pia ..... 441/79
5,372,527 A * 12/1994 Flores Cardona ..... 440/44

FOREIGN PATENT DOCUMENTS

DE 3921373 A1 * 1/1991

* cited by examiner

*Primary Examiner* — Edwin Swinehart

(74) *Attorney, Agent, or Firm* — Chun-Ming Shih

(57) ABSTRACT

A rudder control assembly used in a boat comprises a control unit having a left control plate and a right control plate; a control unit having a left connecting unit and a right connecting unit; a front end of the control unit being connected to the left control plate and the right control plate; a rudder unit installed at a tail end of the boat; the rudder unit including a right shaft; a rudder body; a left extension plate, a right extension plate, a driving plate and a rudder; The right shaft is connected to the boat body and rotatable axially. A lower end of the right shaft is connected to the driving plate. The driving plate is connected to the left connecting unit and the right connecting unit. The left connecting unit and the right connecting unit are hard rods.

5 Claims, 12 Drawing Sheets

RUDDER CONTROL ASSEMBLY OF A BOAT

FIELD OF THE INVENTION

The present invention relates to a rudder control assembly, wherein a rudder unit is installed at a manual controlled boat which is connected to a control unit through a connecting unit. The driver can control the control unit by the treading operation of legs. Thereby the rudder unit is driven by the connecting unit. The feature of the present invention is that the conventional soft ropes are removed and hard rods are used. The driving operation is performed by pushing backwards instead of the conventional pulling forwards. Thereby not only controlling the direction change of boat rudder, but also water flow below the boat can be informed to the driver.

BACKGROUND OF THE INVENTION

Most the prior art manual control boats are controlled through paddles instead of rudders. However in changing the direction of the boat, the paddles are used, but the paddle is operated at only one side of the boat so that the speed of the boat must be reduced and the gravitation center of the boat is displaced.

In another boat structure disclosed in U.S. Pat. No. 6,612,252, a boat has two treadles controlled by legs of the drivers for controlling the direction change of the rudder. Ropes are connected between the treadles and the rudders. In this example, the ropes are soft. They only have the function of changing the direction of rudder. However the water flow under the boat cannot be detected by drivers immediately.

SUMMARY OF THE INVENTION

Accordingly, the primary object of the present invention is to provide a rudder control assembly, wherein a rudder unit is installed at a manual controlled boat which is connected to a control unit through a connecting unit. The driver can control the control unit by the treading operation of legs. Thereby the rudder unit is driven by the connecting unit. The feature of the present invention is that the conventional soft ropes are removed and hard rods are used. The driving operation is performed by pushing backwards instead of the conventional pulling forwards. Thereby not only controlling the direction change of boat rudder, but also water flow below the boat can be informed to the driver.

A rudder control assembly used in a boat comprises a control unit having a left control plate and a right control plate; a control unit having a left connecting unit and a right connecting unit; a front end of the control unit being connected to the left control plate and the right control plate; a rudder unit installed at a tail end of the boat; the rudder unit including a right shaft; a rudder body; a left extension plate, a right extension plate, a driving plate and a rudder; The right shaft is connected to the body and rotatable axially. A lower end of the right shaft is connected to the driving plate. The driving plate is connected to the left connecting unit and the right connecting unit. The left connecting unit and the right connecting unit are hard rods.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
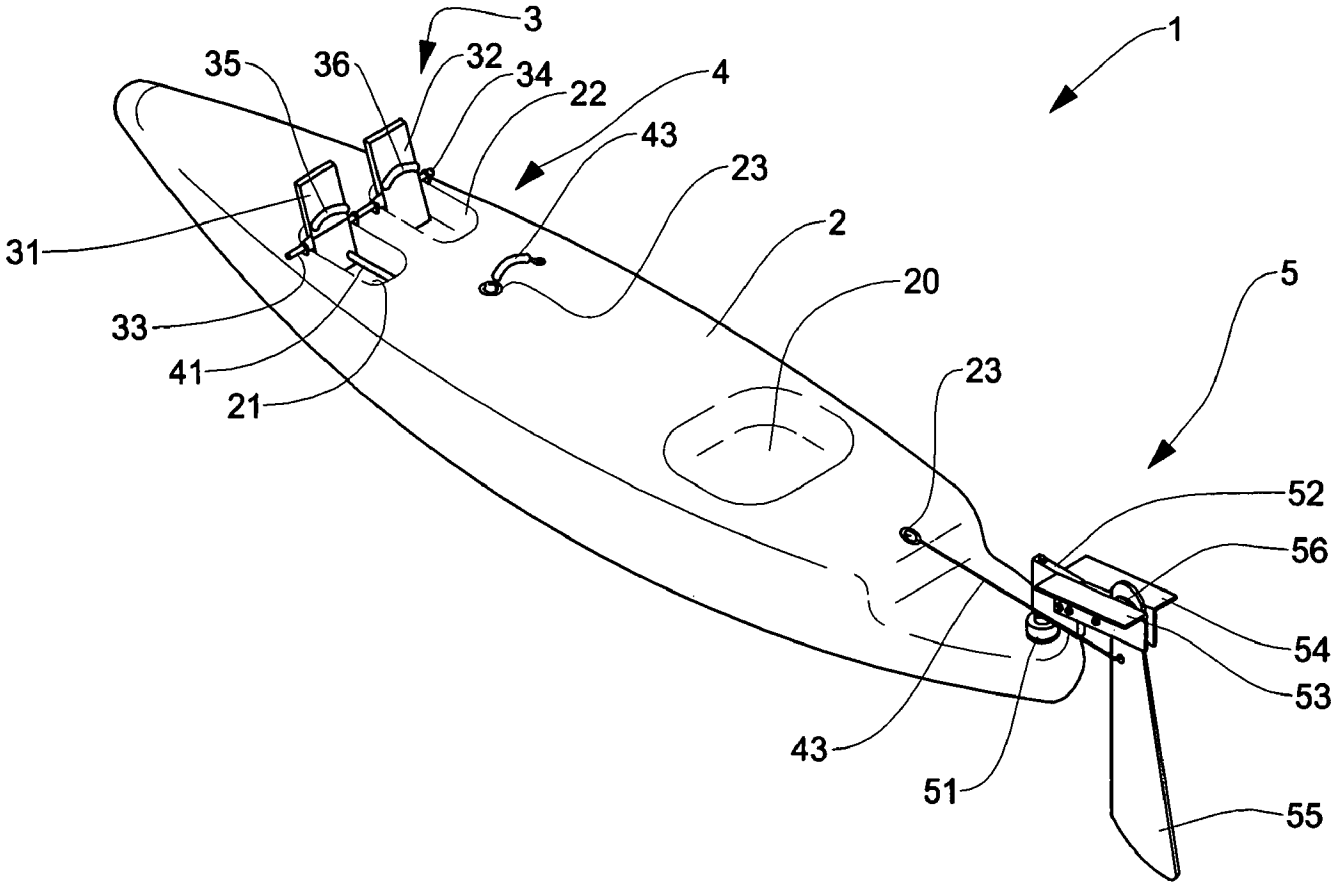
FIG. 1 is a perspective view of the present invention.
Figure 2:
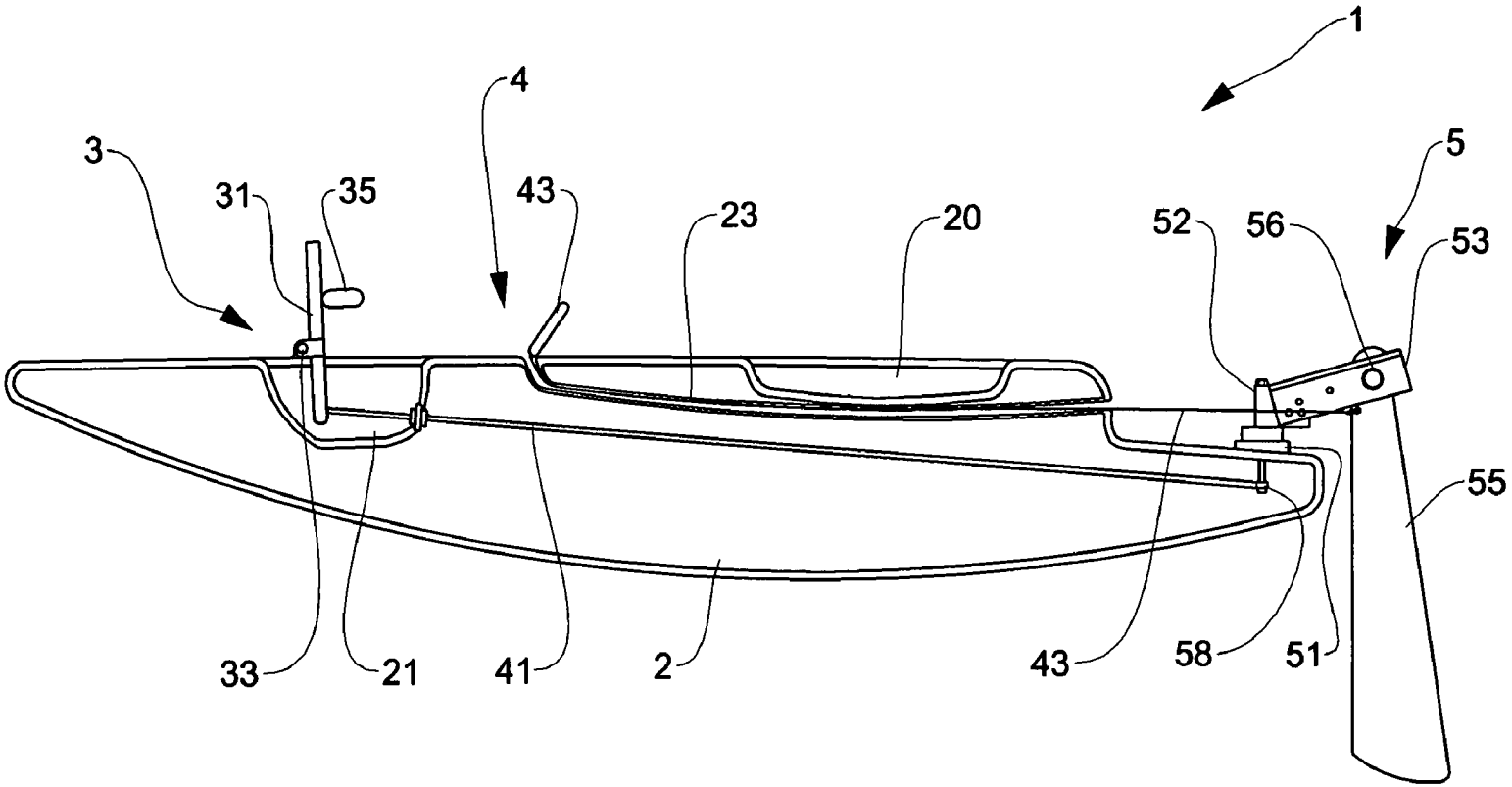
FIG. 2 is a schematic view of the present invention.
Figure 3:
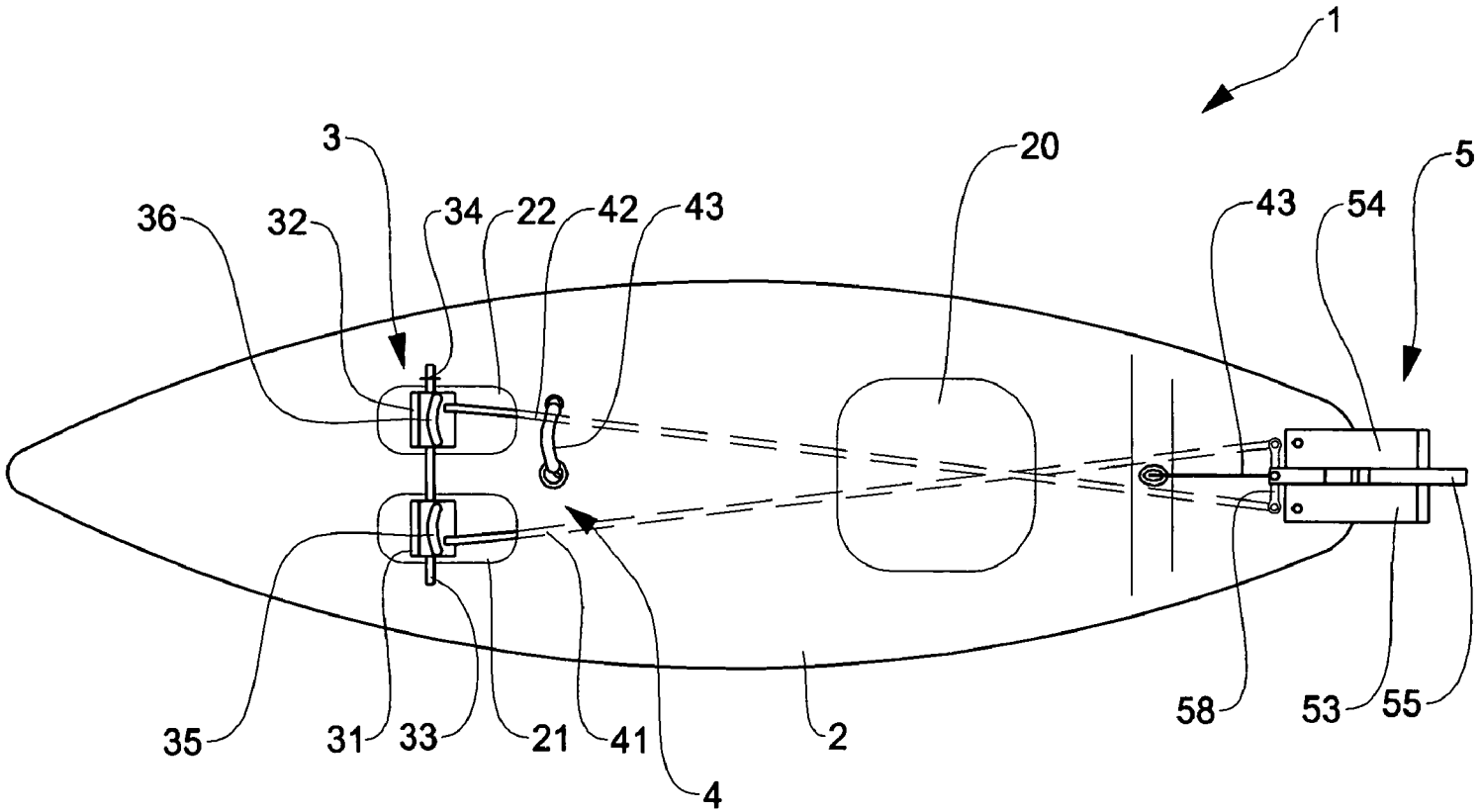
FIG. 3 is a top view of the present invention.

Referring to FIGS. 1, 2, and 3, the preferred embodiment of the rudder control assembly of the present invention is illustrated. The rudder control assembly is installed in a boat 1. The boat 1 has the following elements.

A boat body 2 is made of material capable of floating in water. Persons can carry the boat body 2 and floats upon water. The boat body 2 has a concave portion 20. People can be in the concave portion 20. Moreover the boat body 2 may contain a left concave portion 21, a right concave portion 22 and a communicating tube 23.

A control unit 3 includes a left control plate 31 and a right control plate 32. The left control plate 31 is installed with a left shaft 33 and a left strip 35. The right control plate 32 is installed with a right shaft 34 and a right strip 36. The left control plate 31 is installed in the left concave portion 21 and the right control plate 32 is installed in the right concave portion 22.

A connecting unit 4 includes a left connecting unit 41, a right connecting unit 42, and a rudder connecting unit 43. The left connecting unit 41 has one end connecting to the left control plate 31. The right connecting unit 42 has one end connecting to the right control plate 32. The rudder connecting unit 43 inserts into the communicating tube 23 to further extend to a tail of the boat.

A rudder unit 5 is installed at the tail end of the boat. The rudder unit 5 includes a rotary shaft 51, a rudder body 52, a left extension plate 53, a right extension plate 54, a rudder 55, and a driving plate 58. The rotary shaft 51 is connected to the boat body 2 and moves axially. The rudder body 52 is installed to the upper side of the rotary shaft 51. The left extension plate 53 and right extension plate 54 are installed at two sides of the rudder body 52. The rudder 55 is connected between the left extension plate 53 and the right extension plate 54 through the pivotal shaft 56. A distal end of the rudder connecting unit 43 is connected to the rudder 55.

The feature of the present invention is that the left connecting unit 41 and the right connecting unit 42 are made of hard rods instead of soft ropes. The rods may be a straight rod or a bended rod.

Figure 4:
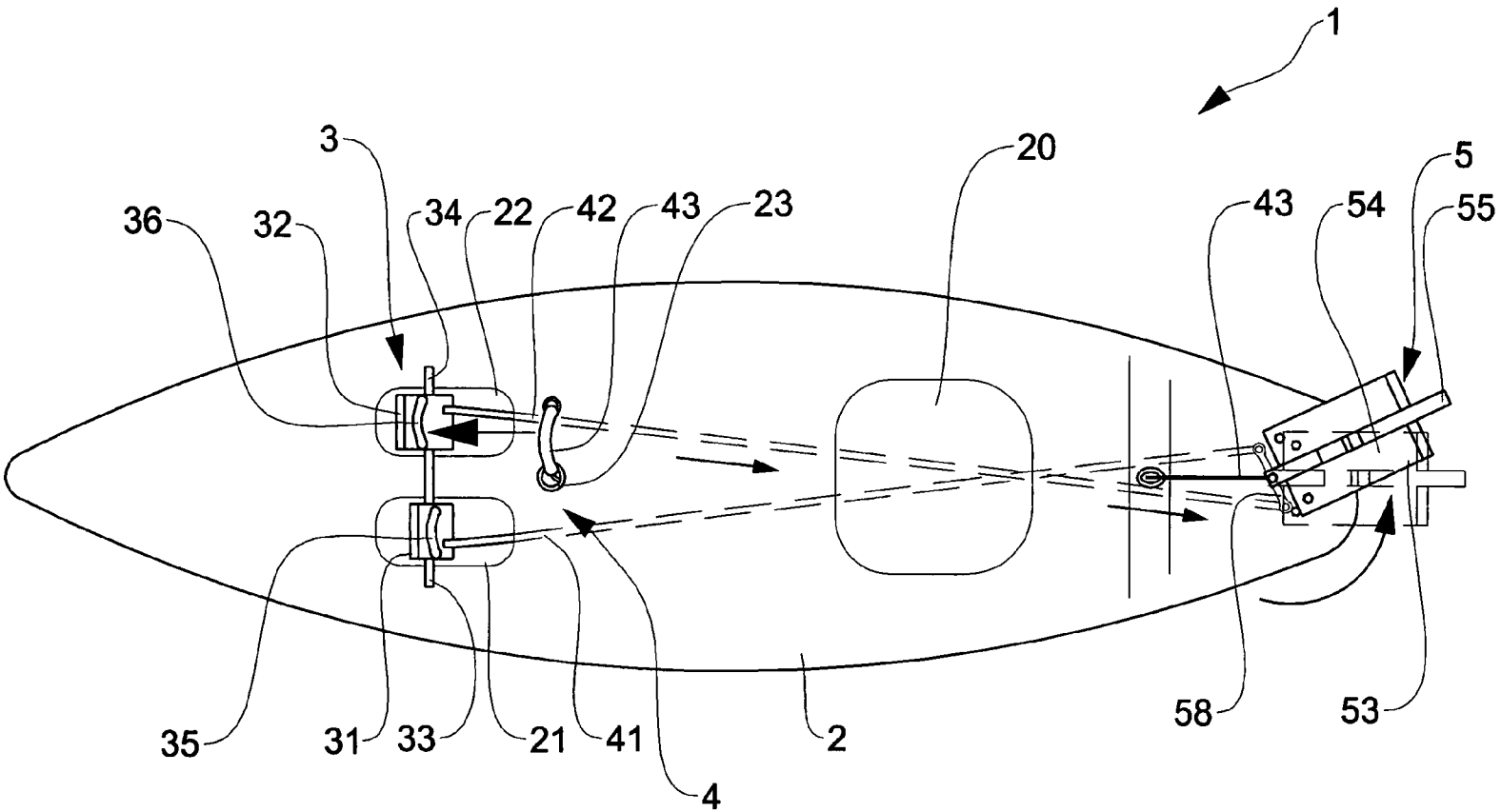
FIG. 4 shows the operation of the present invention.
Figure 5:
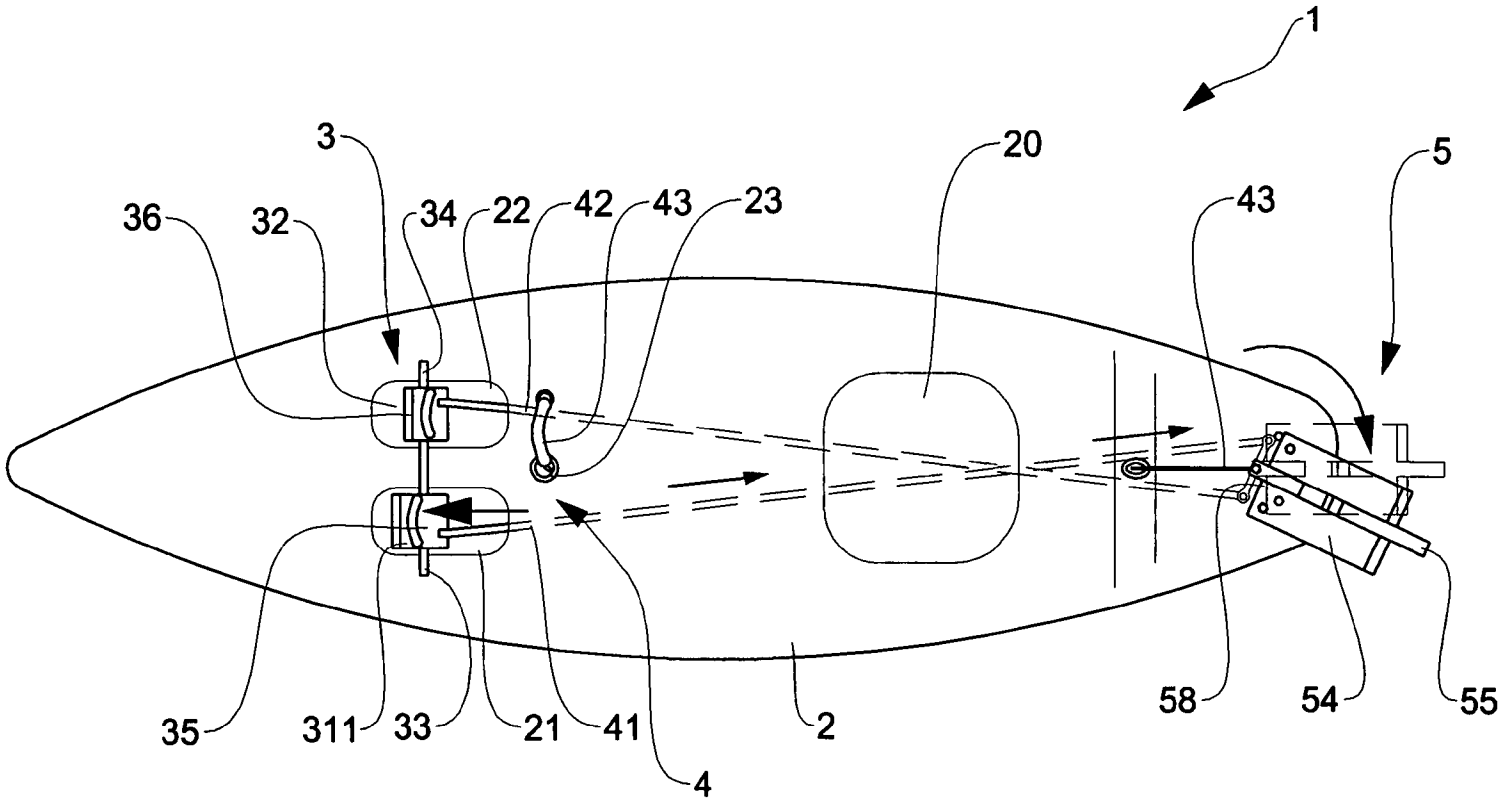
FIG. 5 is a top view showing the operation of the present invention.

By above structure, the left control plate 31 is connected to the rudder unit 5 through the left connecting unit 41. The right control plate 32 is connected to the rudder unit 5 through the right connecting unit 42. Therefore, referring to FIGS. 4 and 5, the driver can locate his (or her) legs upon the left control plate 31 by using the left strip 35 and upon the right control plate 32 by using the right strip 36. By treading one of the left control plate 31 and the right control plate 32, the orientation of the rudder unit 5 is controllable. The control is very easy and convenient. The feature is that if it is desired to turn left, the left leg treads and if it is desired to turn right, the right leg treads. The operation is easy.

Since the left connecting unit 41 and the right connecting unit 42 are made of hard rod. In operation, by the principle of the treading and push backwards, the direction of the rudder unit 5 is changed. Especially, when the rudder unit 5 encounters water flow, the state is transferred to the legs through the left connecting unit 41, right connecting unit 42, left control plate 31 and right control plate 32 and then to the brain of the driver. Thereby the user can know the state of water flow and control the boat. However the prior art cannot achieve the same effect. It must know that the water flow under the boat cannot be seen by eyes. In the present invention, by the rudder unit 5, left connecting unit 41, right connecting unit 42, left control plate 31, and right control plate 32, states of water flow are transferred to the driver and then to the brain of the driver. The driver can react immediately.

Figure 6:
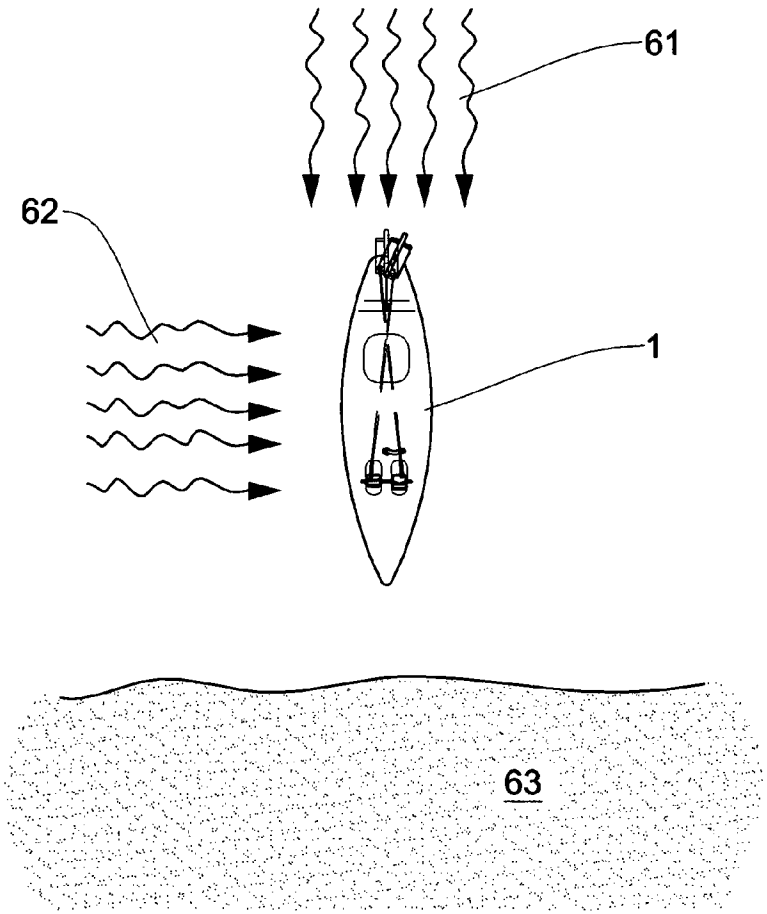
FIG. 6 is a schematic view showing that the boat moves transversally toward land and a water flows transversally below the boat.
Figure 7:
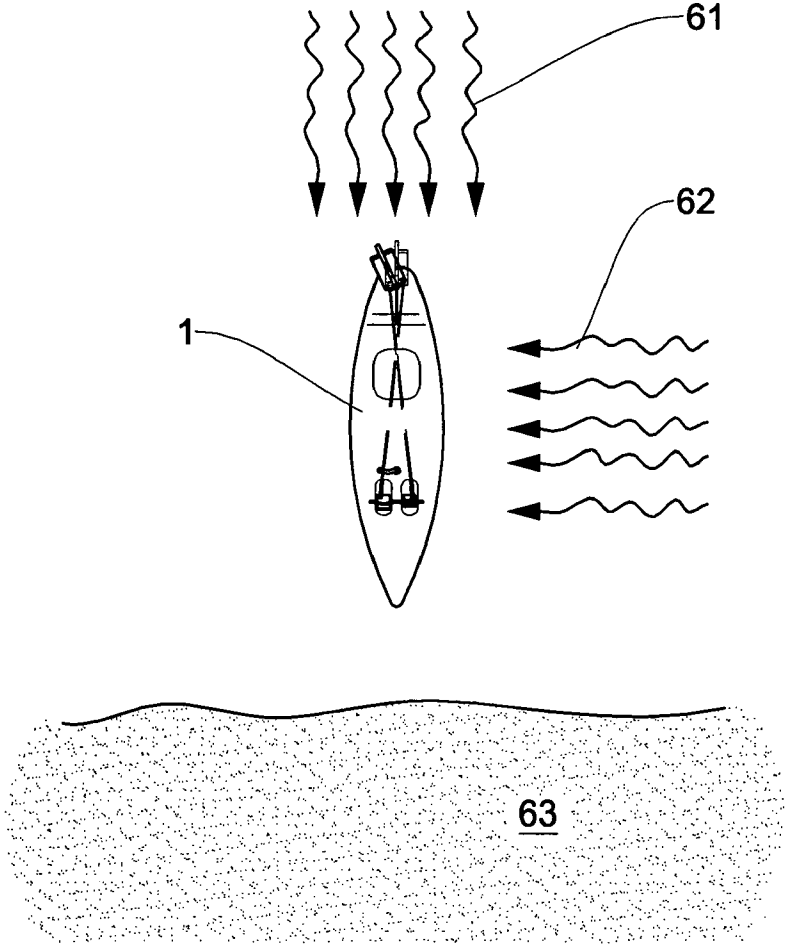
FIG. 7 is a schematic view showing that the boat moves longitudinally toward land and a water flows transversally below the boat.

The principle of the present invention will be described herein. Referring to FIGS. 6 and 7, the boat 1 travels towards the seashore 63. A transversal reverse water flow 62 is below the boat. The energy of the water flow will cause that the rudder unit 5 to change direction (in this moment, the left control plate 31 and the right control plate 32 are not controlled to change direction). The driver can have the message from the left control plate 31 and the right control plate 32 and determines the control the direction (it is called as a tracing active control) so that the boat 1 can react the message immediately. Meanwhile, if the resistance force of the left control plate 31 or the right control plate 32 is adjusted (i.e., the react force of the rudder unit 5) to balance the longitudinal sea wave 61 so as to transversally move. Meanwhile, the rudder unit 5 will transfer the message to the brain (the brain can control the treadle and the rod). When moving transversally, the speed of the water flow is reduced, the rudder unit 5 will sense the acceleration and the variation of the speed. The pressure message will transfer to brain through the left connecting unit 41, right control plate 32, left control plate 31 and the right control plate 32. Then the brain determines the optimum time for movement (the control is changed so that the boat 1 moves forwards).

Since in the prior art, the left connecting unit and the right connecting unit are rods which can absorb the react forces from the left connecting unit 41 and the right connecting unit 42. If the driver determines not to move, the energy of the longitudinal sea wave 61 will reduce. The rudder unit 5 will release the absorbed energy so as to have an effect opposite to the longitudinal wave 61. Thereby the boat 1 separates from the rear side. This function is called as the active control of sensing energy so that the boat 1 can response the state immediately. Moreover, since the direction of the boat 1 is changed, the boat 1 can travel steadily.

In the prior art, the driver do not care the water flow below the boat so that it is possible that the drive will tense up. If now a water flow is parallel to the sea wave, the driver cannot react the state of change of the movement reversed to the water flow. At this moment, the pressure message of water flow from the treadle is reversed to the direction for controlling the treadle. It is necessary to change direction to control the treadle by another leg. However the react is too slow to well control the boat.

Moreover in the present invention, the hard rods are used instead of the conventional soft ropes. If transversal water flows below the boat, the water flow will make the rudder to change direction (the orientations of the left control plate and the right control plate are not changed). The driver can receive the response from the control plates and can determine the direction to be changed. The feature is that the driving state is changed to pull forwards from pushing backwards. Thereby when the treadle response the state of water flow, the correct moving message can be provided to the driver so that the driver can well control the direction of boat (when the boat move rightwards along the direction of water flow, the right control plate will move forwards. The driver only needs to tread the control plate by the right leg. The boat is safe). The driver can control the boat freely.

Figure 8:
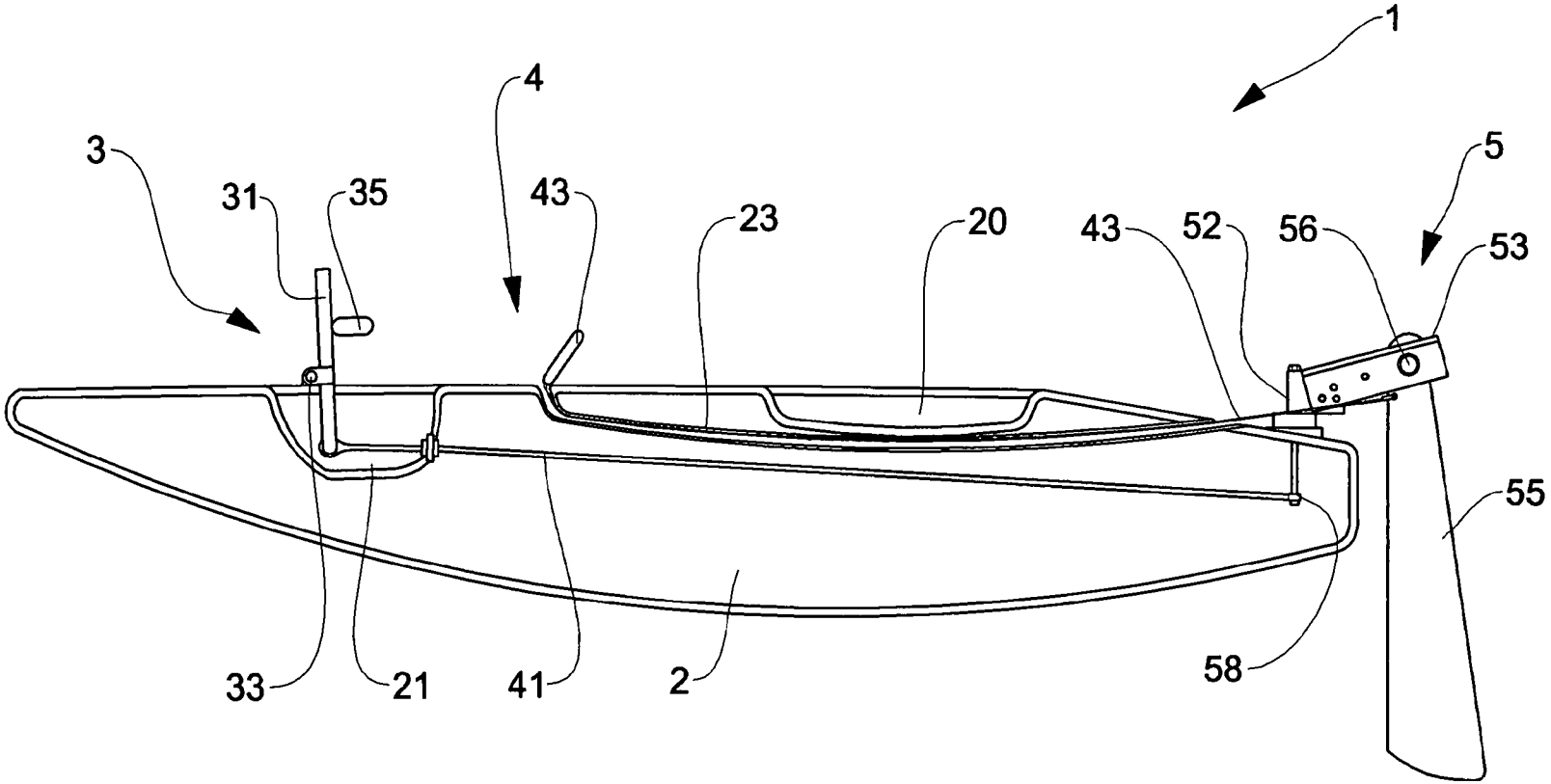
FIG. 8 is a top view of another embodiment of the present invention.

Referring to FIG. 8, the tail of the boat 1 has another shape.

Figure 9:
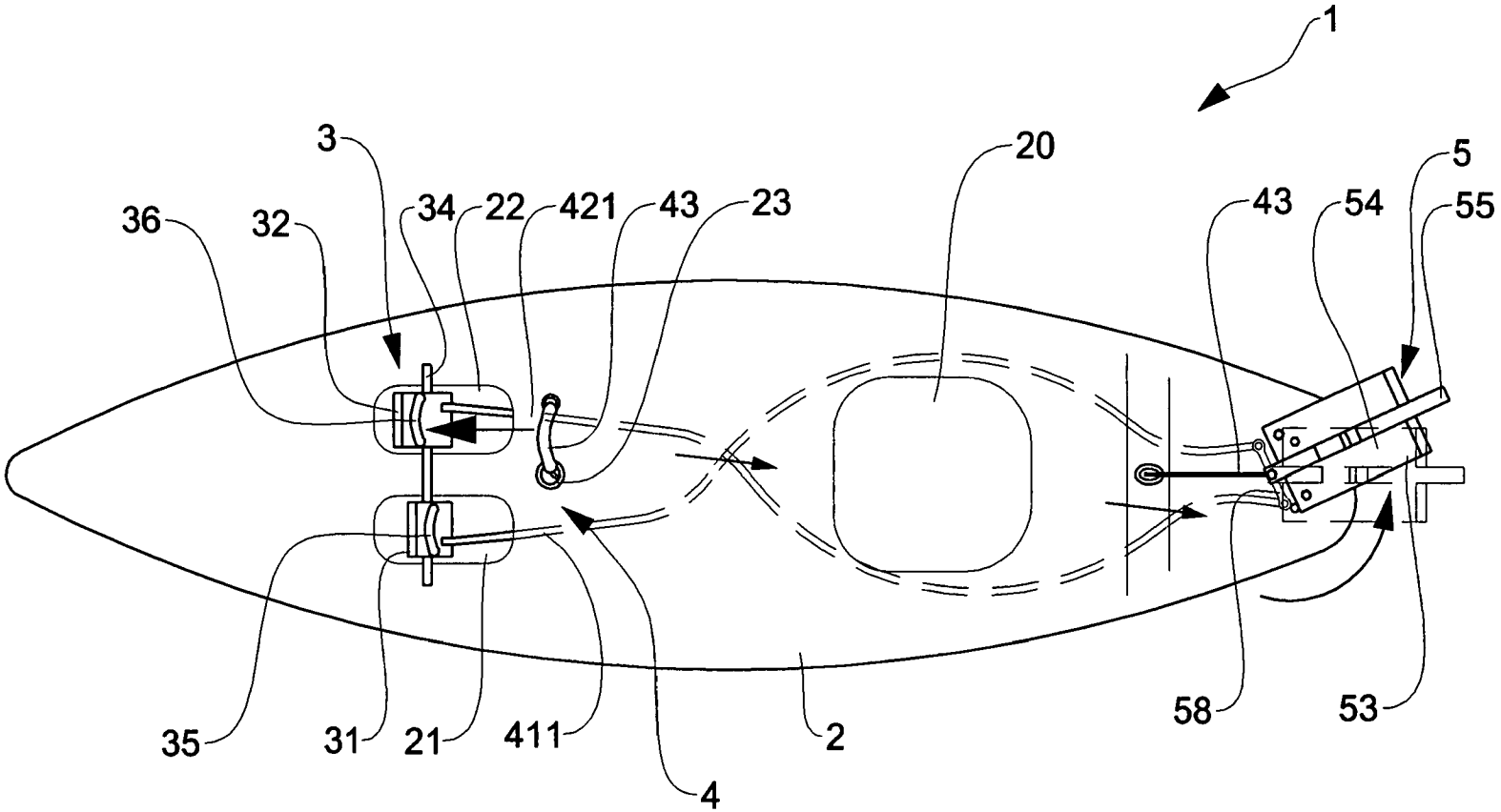
FIG. 9 is a top view of another embodiment of the present invention.
Figure 10:
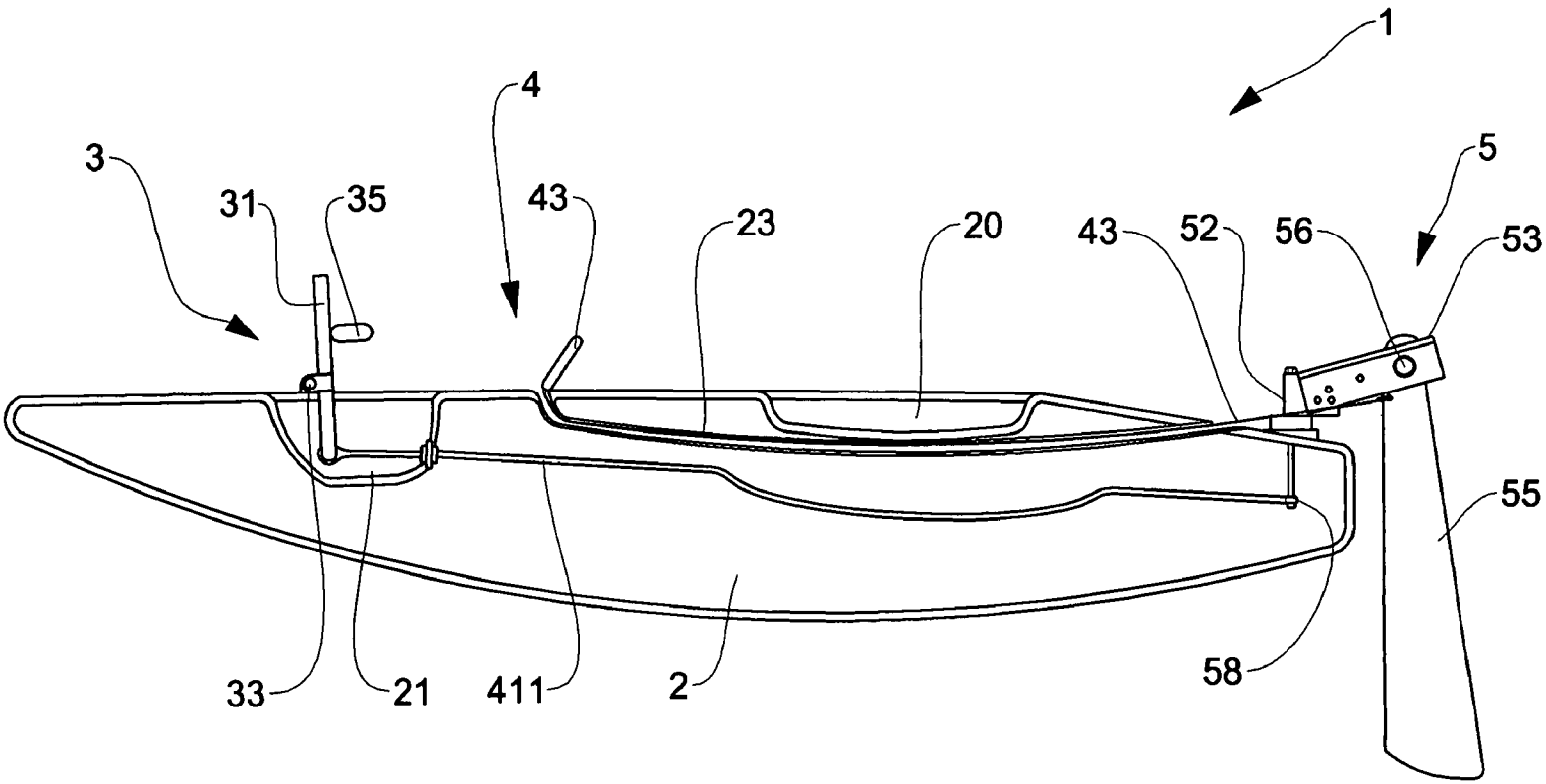
FIG. 10 is a lateral view of another embodiment of the present invention.

Referring to FIGS. 9 and 10, another embodiment of the present invention is illustrated. It is illustrated that the left connecting unit 41 and the right connecting unit 42 have slightly curved shape.

Figure 11:
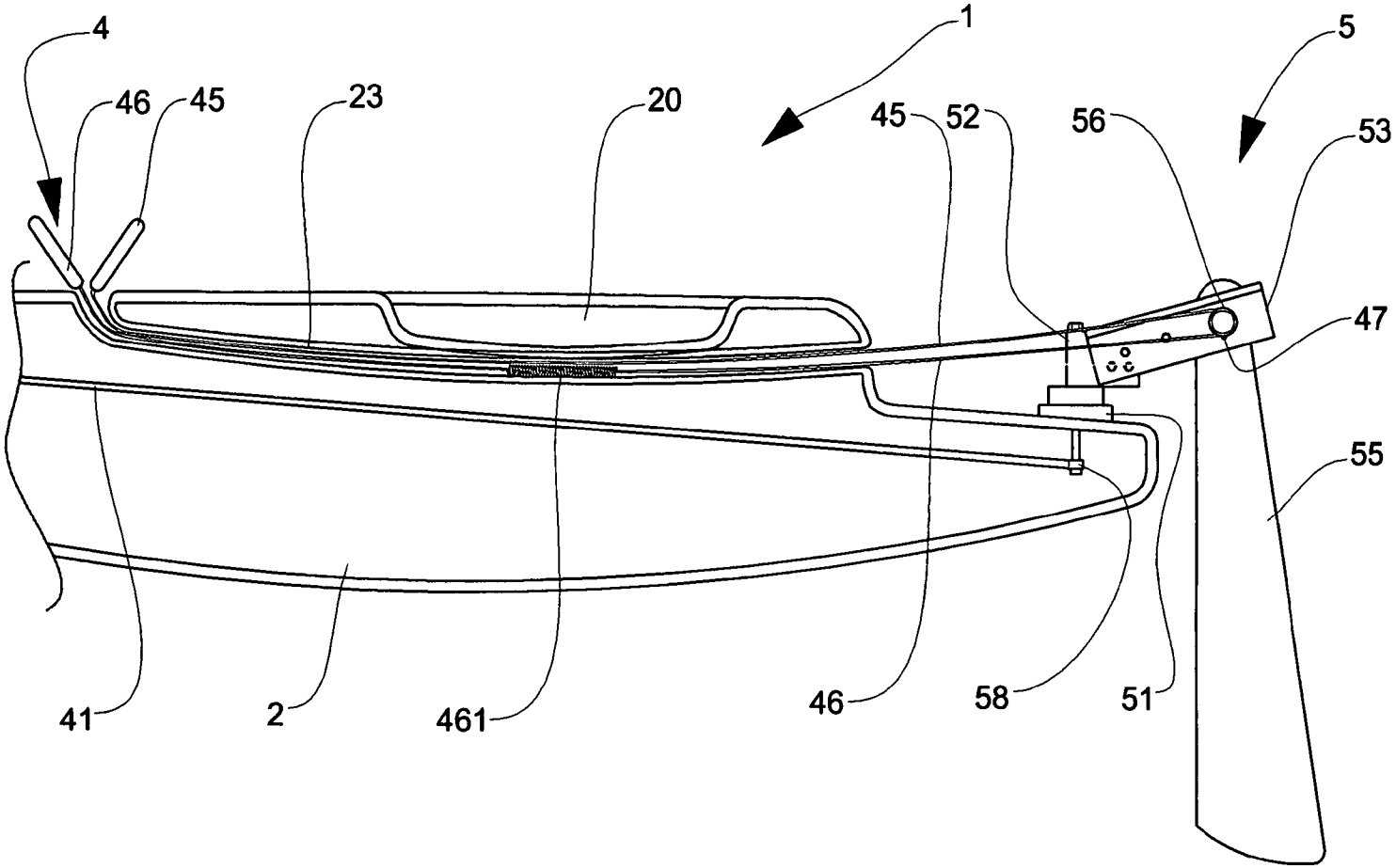
FIG. 11 is a schematic view showing that a rope is installed in a communicating tube.
Figure 12:
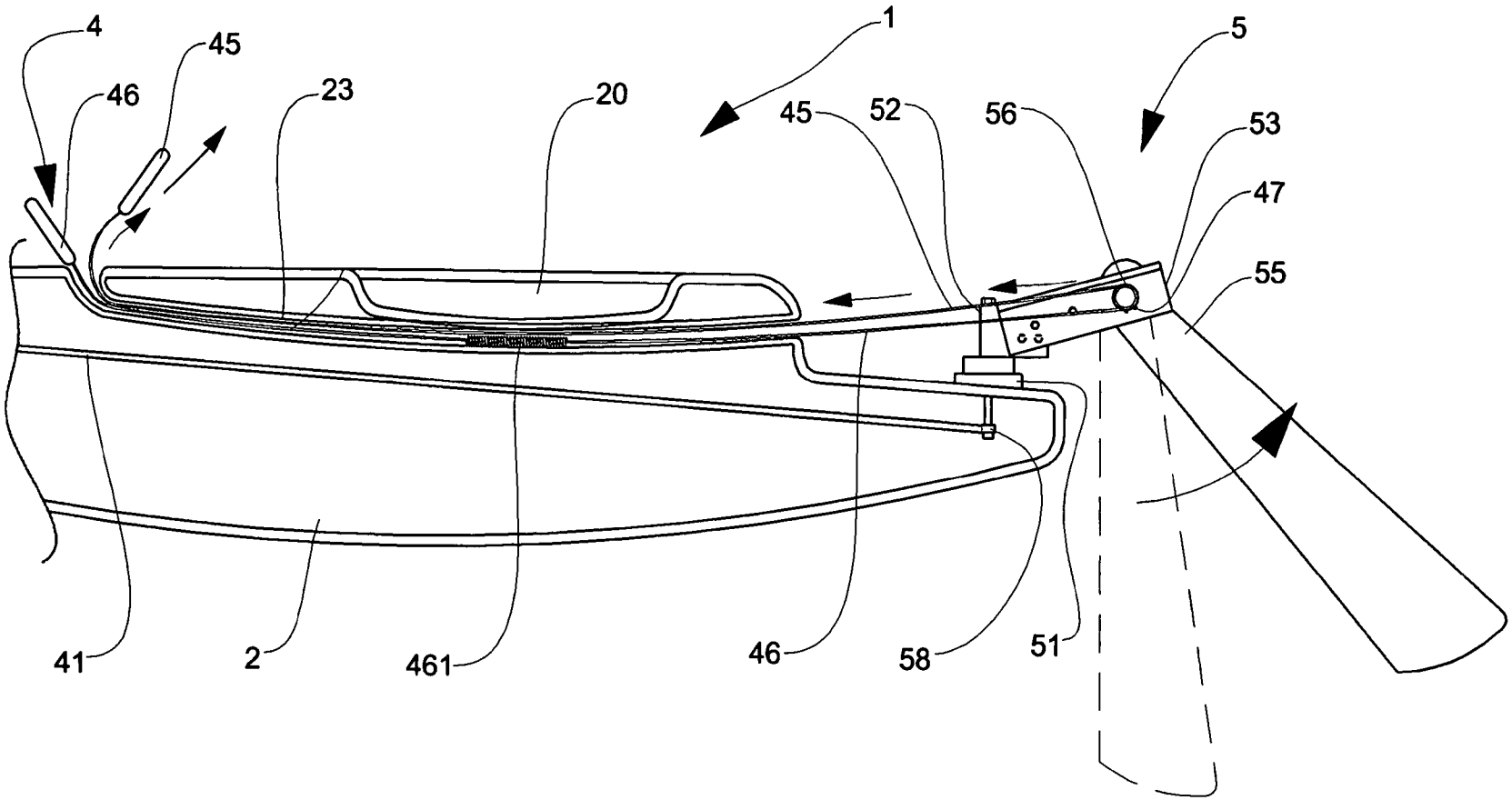
FIG. 12 is a schematic view showing the operation of the rope in the communicating tube.

FIG. 11 shows that in the communicating tube 23, a first rope 45 and a second rope 46 are installed therein. The first rope 45 and second rope 46 are connected as a U shape. A distal end thereof is connected to the rudder unit 5 and around the pivotal shaft 56. A retaining portion 47 serves to fix the structure. An elastic body 461 is installed at the second rope 46. Thereby when the first rope 45 is pulled (referring to FIG. 12), the pivotal shaft 56 is driven, and the rudder 55 is lifted. The function is that when the boat 1 moves in a shallow area with reefs therein. The rudder 55 will not be destroyed. When the first rope 45 is not pulled upwards, the elastic body 461 of the second rope 46 is used to pull the rudder 55 downwards to be at a state illustrated in FIG. 11.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A rudder control assembly used in a boat comprising:

a control unit having a left control plate and a right control plate;

a connecting unit having a left connecting unit and a right connecting unit, a front end of the connecting unit being connected to the left control plate and the right control plate; and a rudder unit installed at a tail end of the boat, the rudder unit including a rotary shaft, a rudder body, a left extension plate, a right extension plate, a driving plate and a rudder;

wherein the rotary shaft is connected to a boat body and rotatable axially; a lower end of the rotary shaft is connected to the driving plate; the driving plate is connected to the left connecting unit and the right connecting unit;

wherein the left connecting unit and the right connecting unit are rods;

wherein the left control plate is installed with a left strip and the right control plate is installed with a right strip;

wherein the rudder is installed between the left extension plate and the right extension plate by using a pivotal shaft; and wherein the boat body contains a communicating tube, the communicating tube, a first rope and a second rope are installed therein; the first rope and second rope are connected as a U shape; a distal end thereof is connected to the rudder unit and around the pivotal shaft; a retaining portion serves to fix the structure; and an elastic body is installed at the second rope.

2. The rudder control assembly as claimed in claim 1, wherein the boat body has a middle concave portion, a left concave portion and a right concave portion.

3. The rudder control assembly as claimed in claim 1, wherein the left control plate and the right control plate are connected to the boat body through a left shaft and a right shaft, respectively.

4. The rudder control assembly as claimed in claim 2, wherein the left concave portion is installed with the left control plate and the right concave portion is installed with the right control plate.

5. The rudder control assembly as claimed in claim 1, wherein the rods are straight or curved.

* * * * *